US011264757B2

(12) United States Patent
Hoffmann

(10) Patent No.: US 11,264,757 B2
(45) Date of Patent: Mar. 1, 2022

(54) CONTROL BOX WITH CABLE-STRAIN RELIEF

(71) Applicant: Oelschläger Metalltechnik GmbH, Hoya/Weser (DE)

(72) Inventor: Jan Hoffmann, Bremen (DE)

(73) Assignee: Oelschläger Metalltechnik GmbH, Hoya/Weser (DE)

( * ) Notice: Subject to any disclaimer, the term of this patent is extended or adjusted under 35 U.S.C. 154(b) by 0 days.

(21) Appl. No.: 16/462,506

(22) PCT Filed: Nov. 7, 2017

(86) PCT No.: PCT/DE2017/100941
§ 371 (c)(1),
(2) Date: May 20, 2019

(87) PCT Pub. No.: WO2018/095462
PCT Pub. Date: May 31, 2018

(65) Prior Publication Data

US 2019/0288443 A1 Sep. 19, 2019

(30) Foreign Application Priority Data

Nov. 23, 2016 (DE) ..... 202016106541.0

(51) Int. Cl.
*H01R 13/58* (2006.01)
*H01R 13/50* (2006.01)
*A47B 9/00* (2006.01)

(52) U.S. Cl.
CPC ..... *H01R 13/58* (2013.01); *A47B 9/00* (2013.01); *H01R 13/50* (2013.01); *H01R 13/582* (2013.01)

(58) Field of Classification Search
CPC ..... H01R 13/50; H01R 13/58; H01R 13/582; A47B 9/00
USPC ..... 439/460
See application file for complete search history.

(56) References Cited

U.S. PATENT DOCUMENTS 2,406,030 A * 8/1946 O'Brien ..... H01R 13/6395 439/353
3,811,104 A * 5/1974 Caldwell ..... H01R 13/6395 439/135
4,105,274 A * 8/1978 Casey ..... H01R 13/6395 439/368

(Continued)

*Primary Examiner* — Abdullah A Riyami
*Assistant Examiner* — Vladimir Imas
(74) *Attorney, Agent, or Firm* — Jonathan M. D'Silva; MMI Intellectual Property

(57) ABSTRACT

Control box, in particular for adjustable items of furniture, such as vertically adjustable tables for example, comprising: a control box housing and a mains plug in a wall of the control box housing, wherein the control box housing has a strain relief device for a mains cable with a main cable socket for connection to the mains plug, characterized in that the strain relief device has an, in particular channel-like, mains cable clamping guide which is arranged upstream of the mains plug in the insertion direction of the mains cable socket and so as to run transversely to the insertion direction in the control box housing and therefore below the mains plug such that the mains cable socket, when it is inserted into the mains plug, at least partially closes the mains cable clamping guide on the top side in such a way that the associated mains cable does not move out of the mains cable clamping guide.

7 Claims, 4 Drawing Sheets

(56) References Cited

U.S. PATENT DOCUMENTS 4,424,407 A * 1/1984 Barbic ..... H01R 13/447 174/67
5,004,433 A * 4/1991 Daoud ..... H01R 13/58 439/460
5,207,583 A * 5/1993 DeBalko ..... H04Q 1/028 379/413.02
5,240,432 A * 8/1993 Daoud ..... H01R 4/2433 439/417
5,964,614 A * 10/1999 Daoud ..... H01R 4/2433 379/413.04
5,993,264 A * 11/1999 Daoud ..... H01R 13/6397 439/557
6,022,233 A * 2/2000 Daoud ..... H01R 13/6397 379/413.04
6,109,953 A * 8/2000 Hashigaya ..... H01R 33/09 439/457
6,443,765 B2 * 9/2002 Ichio ..... H01R 13/5208 439/274
6,552,268 B2 * 4/2003 Daoud ..... H01R 4/2433 174/59
7,121,871 B2 * 10/2006 Duesterhoeft ..... H01R 4/2433 439/417
7,488,196 B2 * 2/2009 Kocher ..... H01R 4/26 439/393
7,938,671 B2 * 5/2011 Hayden, Sr. ..... H01R 13/5833 439/371
8,308,501 B2 * 11/2012 Mostoller ..... F21V 27/02 439/441
8,602,806 B2 * 12/2013 Chou ..... H01R 13/6392 439/345
9,147,973 B1 * 9/2015 Madison ..... H01R 13/6395
9,463,564 B2 * 10/2016 Macauda ..... H01R 25/003
9,825,414 B2 * 11/2017 Armstrong ..... H01R 13/447
9,948,025 B2 * 4/2018 Hashimoto ..... H01R 13/14
9,991,627 B1 * 6/2018 Hemme ..... H01R 13/58
10,181,680 B1 * 1/2019 Crowder ..... H01R 13/639
10,230,195 B2 * 3/2019 Klein ..... H01R 13/64
10,326,241 B2 * 6/2019 Jacobson ..... H01R 13/6395
10,439,321 B2 * 10/2019 Klein ..... E05F 11/385
2007/0270025 A1 * 11/2007 Mabry ..... H01R 13/72 439/470
2009/0149055 A1 * 6/2009 Uchikawa ..... H01R 13/6395 439/367
2010/0233898 A1 9/2010 Hayden, Sr.
2012/0315772 A1 * 12/2012 Joschika ..... H01R 12/7011 439/55
2015/0194832 A1 * 7/2015 Benigno ..... H02J 7/0044 320/111
2017/0214201 A1 7/2017 Armstrong et al.

* cited by examiner

CONTROL BOX WITH CABLE-STRAIN RELIEF

BACKGROUND

The present invention relates to a control box, in particular for adjustable items of furniture, such as vertically adjustable tables for example, comprising: a control box housing and a mains plug in a wall of the control box housing, wherein the control box housing has a strain relief device for a mains cable with a mains cable socket for connection to the mains plug, to a control box system comprising said control box and to an arrangement comprising the control box and a mains cable with a mains cable socket.

SUMMARY

The present invention is intended to be based on the example of a vertically adjustable table comprising a tabletop which is fitted on a base frame. The base frame has longitudinally adjustable table legs. The longitudinal adjustment of the table legs and therefore the vertical adjustment of the table is performed by means of motors which are driven by means of control boxes. For the purpose of power supply, the control boxes have mains plugs (built-in plugs) which are accessible from the outer side of the control box housing.

Strain relief arrangements, in particular for a mains cable, are known in principle in housings for electrical devices. The strain relief arrangement often takes the form of metal or plastic clips. However, clip-free or screw-free strain relief arrangements are also available. For example, CH 689 683 A5 discloses a housing having an apparatus for cable strain relief. The objective of the known cable strain relief arrangement is to prevent a cable from being pulled out of an apparatus housing. This is achieved by way of two clamping wings, which are connected to a housing part, being provided. These clamping wings have edges which are parallel to one another and are at a distance from one another, said distance being smaller than the diameter of the cable. The clamping wings are positioned obliquely in the direction toward the housing interior. If the cable is pushed between the parallel edges, said cable is deformed. This produces a force which holds the cable. When an attempt is made to pull the cable out of the apparatus, said cable is held by the resulting friction between the surface of the cable and the edges of the clamping wings.

EP 2 452 589 B1 discloses a cable strain relief arrangement for a control box. The control box has one or more cable or line guides for guiding a line/a cable between two connection sides of the control box housing, wherein the line guides are designed as an integral part of the outer side of the control box housing. In addition, the cable or line guide has at least one fastening element for a line. However, the known strain relief arrangement does not provide strain relief for a mains cable, requires a relatively complex configuration of the control box housing and is also difficult to handle since the respective cable has to be "inserted" into the cable guide on an outer side of the control box housing in a laborious manner and accordingly can also be removed from there only with a relatively great effort.

Therefore, the present invention is based on the object of providing a strain relief arrangement of relatively simple configuration for a mains cable in a control box of the kind mentioned at the outset.

According to the invention, this object is achieved in the control box of the kind mentioned at the outset in that the strain relief device has an, in particular channel-like, mains cable clamping guide which is arranged upstream of the mains plug in the insertion direction of the mains cable socket and so as to run transversely to the insertion direction in the control box housing and therefore below the mains plug such that the mains cable socket, when it is inserted into the mains plug, at least partially closes the mains cable clamping guide on the top side in such a way that the associated mains cable does not move out of the mains cable clamping guide. Very generally, the control box housing can be a housing for any electrical device. In addition, the strain relief arrangement can be provided not only for a mains cable but rather for any desired electrical cable in principle.

Furthermore, the mains plug (for example built-in plug) or more generally the connection socket (device plug socket) in the control box housing and the mains cable socket of the mains cable can also be interchanged, that is to say the male and female configuration can be interchanged.

The strain relief device is preferably integrally formed with the control box housing, for example as an integral part of an outer side.

Furthermore, this object is achieved by a control box system comprising a control box as claimed and a mains cable with a mains cable socket.

Finally, this object is also achieved by an arrangement comprising a control box as claimed and a mains cable with a mains cable socket, wherein the mains cable is guided in the mains cable clamping guide in a clamped manner and the mains cable socket, in a manner fully covering the mains cable clamping guide in the insertion direction, is inserted into the mains plug so as to form a loop in the mains cable.

Provision can be made in the control box for the mains cable clamping guide to have at least two opposite clamping lugs or clamping jaws which preferably extend parallel to one another.

Finally, provision can be made in the control box system for the mains cable to be guided in the mains cable clamping guide in a clamped manner and the mains cable socket, in a manner fully covering the mains cable clamping guide in the insertion direction, to be inserted into the mains plug so as to form a loop in the mains cable.

BRIEF DESCRIPTION OF DRAWINGS

The invention is based on the surprising finding that, owing to the specific arrangement and orientation of a cable clamping guide in relation to the mains plug in the control box housing, the control box housing only has to be slightly modified so that this is not associated with a high level of costs and the strain relief, including the mains cable socket, can be realized and also reversed again in a simple manner.

Further features and advantages of the invention can be found in the appended claims and the following description in which an exemplary embodiment will be explained in detail with reference to the schematic drawings, in which:

DETAILED DESCRIPTION

Figure 1:
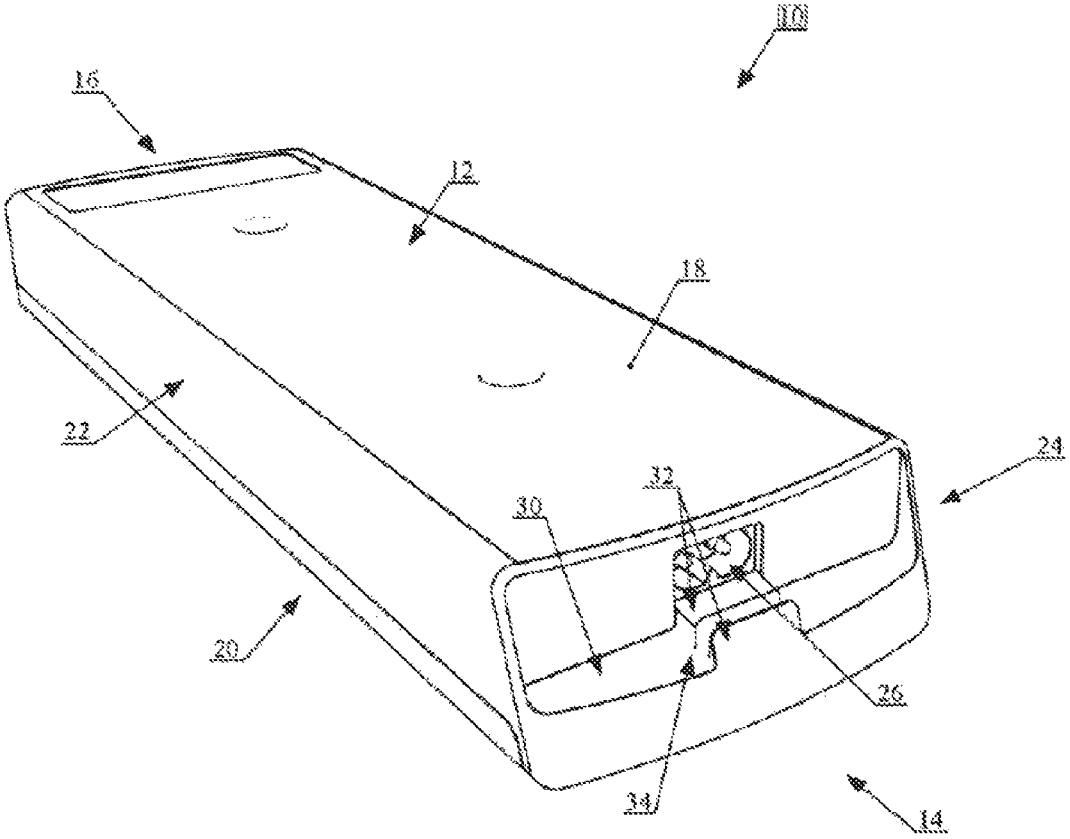
FIG. 1 shows a perspective view of a control box housing on a connection side with a mains plug.

FIG. 1 shows a bar-type control box 10 for controlling a vertically adjustable table (not shown). The control box 10 has a control box housing 12 with opposite connection sides 14 and 16, to which electrical cables can be connected, and a top side 18 and also a bottom side 20 and side walls 22, 24.

The control box 10, in the connection side 14, also has, centrally in this example, a mains plug (built-in plug) 26 for supplying electrical energy to a controller etc. (not shown) which is located in the control box 10. The mains plug 26 is arranged such that a mains cable socket 28 (see FIGS. 2 and 3) of a mains cable 36 (see FIGS. 2 and 3) has to be inserted into the mains plug 26, in this example, substantially normally to the connection side 14.

The connection side 14 has a lower projection 30 which, in this example, extends somewhat below the mains plug 26 over the entire width of the connection side 14. Two projections or clamping walls 32, 32, which are situated opposite one another and run parallel to one another, are arranged centrally on the projection as part of a mains cable clamping guide 34 for guiding the mains cable 36 in a clamped manner, wherein the clamping walls have different geometries in this example. The height of the clamping walls 32 is selected such that the mains plug 26 is still accessible to the mains cable socket 28. The effect of guiding in a clamped manner is achieved by suitably selecting the distance a (see FIG. 4) between the two clamping walls 32, 32 with respect to the mains cable 36 to be used to be preferably equal to the thickness d of the mains cable 36 (see FIG. 4) or somewhat smaller.

Figure 2:
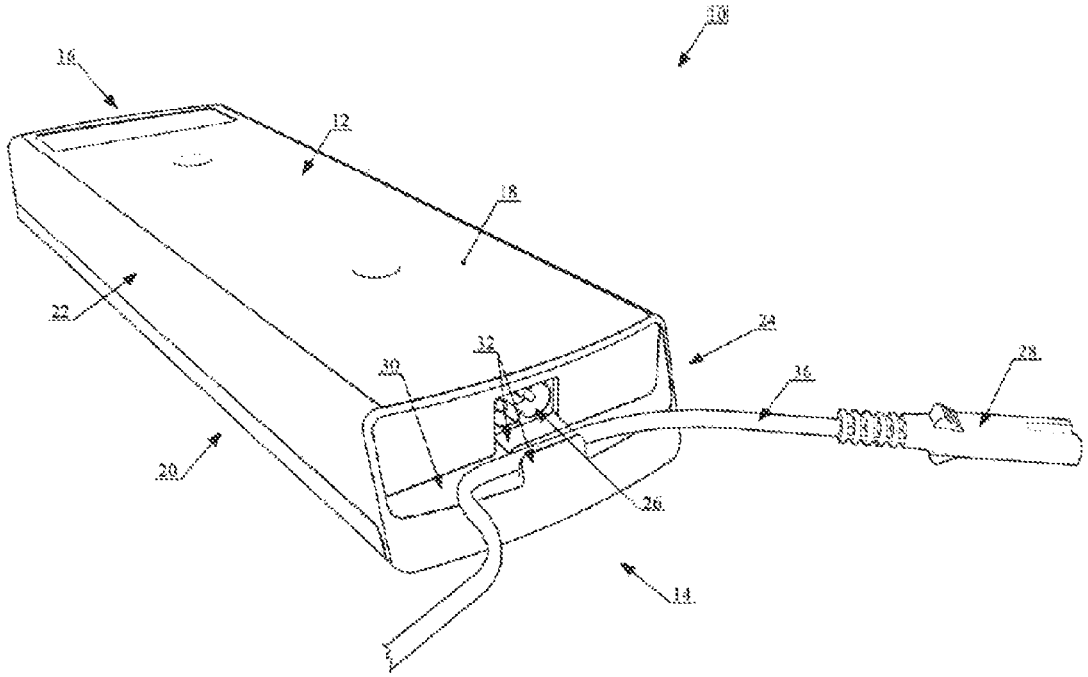
FIG. 2 shows a similar perspective view to FIG. 1, but with a mains cable already inserted into a mains cable clamping guide.

In FIG. 2, the mains cable 36 has already been laid in the mains cable clamping guide 34 and is therefore fixed therein by clamping. The mains cable 36 with the mains cable socket 28 is arranged in the mains cable clamping guide 34 such that the mains cable socket 28 can still be inserted (see FIG. 3) into the mains plug 26 so as to form a loop (see FIG. 3).

Figure 3:
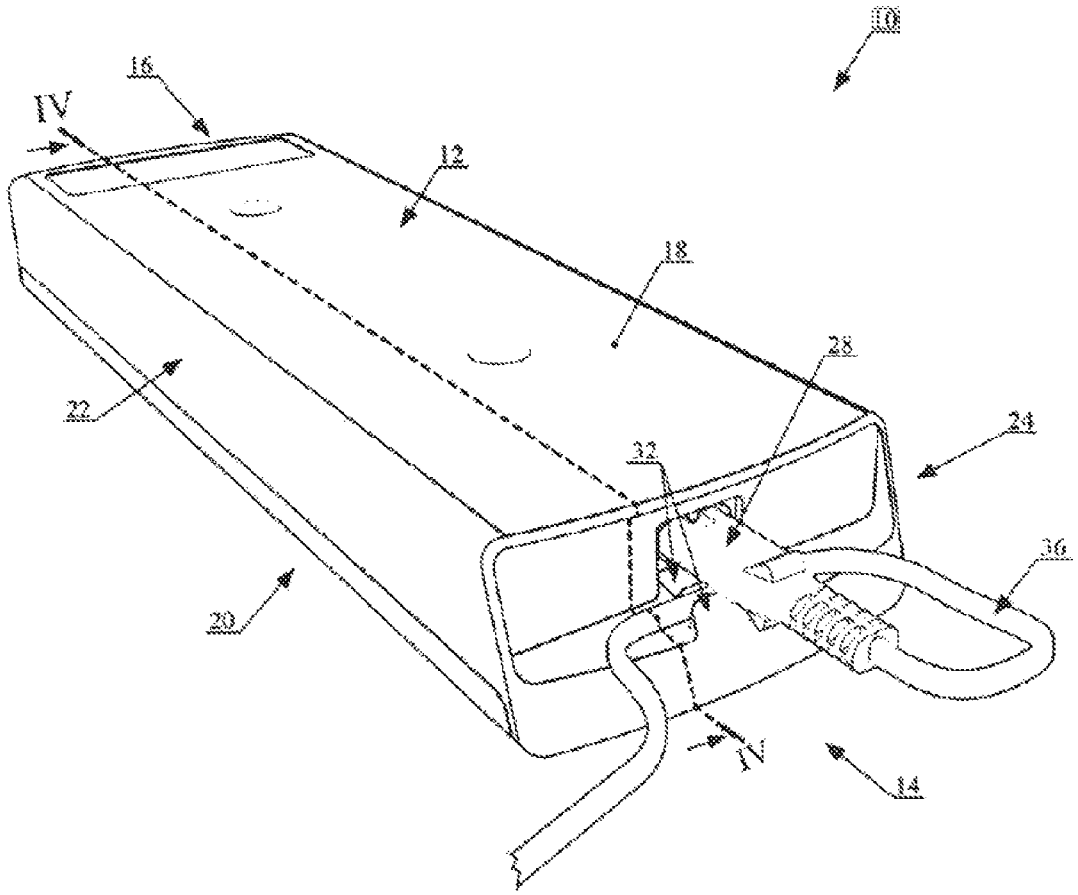
FIG. 3 shows a similar perspective view to FIG. 2, but now with a mains cable socket of the mains cable also inserted into the mains plug.
Figure 4:
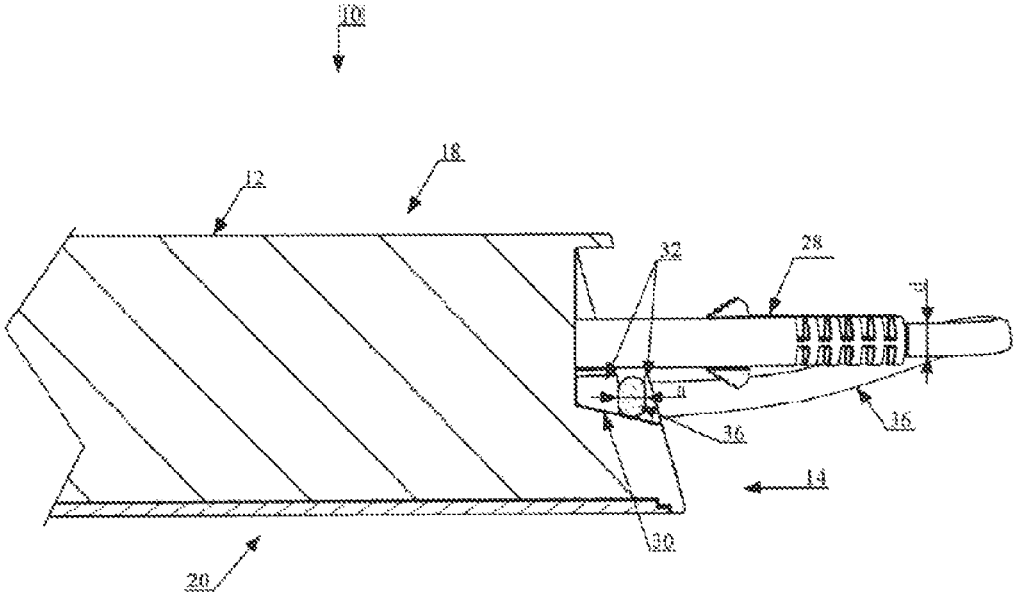
FIG. 4 shows a partially sectioned view along line IV-IV in FIG. 3.

As can also be seen by consulting FIG. 4, the mains cable 36, when in the state shown in FIG. 3, is prevented from moving upward out of the mains cable clamping guide 34 again by the inserted mains cable socket 28.

The features of the invention which are disclosed in the present description, in the drawings and also in the claims can be important both individually and in any desired combinations for the purpose of implementing the invention in its various embodiments.

The invention claimed is:

1. A control box for adjustable items of furniture, comprising:

a control box housing; and a mains plug in a wall of said control box housing, wherein said control box housing has a strain relief device for a mains cable with a mains cable socket for connection to said mains plug, characterized in that said strain relief device has a channel-like mains cable clamping guide arranged upstream of said mains plug in the insertion direction of said mains cable socket and so as to run transversely to said insertion direction in said control box housing and therefore below said mains plug such that when said mains cable socket is inserted into said mains plug, said mains cable socket at least partially closes said mains cable clamping guide on the top side in such a way that the associated said mains cable does not move out of said mains cable clamping guide.

2. The control box of claim 1 wherein said mains cable clamping guide has at least two opposite clamping lugs, clamping walls, or clamping jaws.

3. The control box of claim 1 wherein said mains cable clamping guide has at least two opposite clamping lugs, clamping walls, or clamping jaws that extend parallel to one another.

4. A control box system, comprising a control box;

a control box housing;

a mains plug in a wall of said control box housing; and a mains cable with a mains cable socket, wherein said control box housing has a strain relief device for said mains cable with said mains cable socket for connection to said mains plug, characterized in that said strain relief device has channel-like mains cable clamping guide arranged upstream of said mains plug in the insertion direction of said mains cable socket and so as to run transversely to said insertion direction in said control box housing and therefore below said mains plug such that when said mains cable socket is inserted into said mains plug, said mains cable socket at least partially closes said mains cable clamping guide on the top side in such a way that the associated said mains cable does not move out of said mains cable clamping guide.

5. The control box system of claim 4 wherein said mains cable is guided in said mains cable clamping guide in a clamped manner and said mains cable socket to fully cover said mains cable clamping guide in said insertion direction, and said mains cable is inserted into said mains plug so as to form a loop in said mains cable.

6. The control box system of claim 4 wherein said mains cable clamping guide has at least two opposite clamping lugs, clamping walls, or clamping jaws.

7. The control box system of claim 4 wherein said mains cable clamping guide has at least two opposite clamping lugs, clamping walls, or clamping jaws that extend parallel to one another.

* * * * *